US011396193B2

(12) United States Patent
Takahashi

(10) Patent No.: US 11,396,193 B2
(45) Date of Patent: Jul. 26, 2022

(54) LABEL PRINTER AND LABEL PRINTER CONTROL METHOD

(71) Applicant: TOSHIBA TEC KABUSHIKI KAISHA, Tokyo (JP)

(72) Inventor: Kota Takahashi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 70 days.

(21) Appl. No.: 17/098,250

(22) Filed: Nov. 13, 2020

(65) Prior Publication Data

US 2021/0213761 A1 Jul. 15, 2021

(30) Foreign Application Priority Data

Jan. 15, 2020 (JP) ..... JP2020-004633

(51) Int. Cl.
*B41J 3/407* (2006.01)
*B41J 13/00* (2006.01)

(52) U.S. Cl.
CPC ..... *B41J 13/0009* (2013.01); *B41J 3/4075* (2013.01)

(58) Field of Classification Search
CPC ..... B41J 13/0009; B41J 3/4075
See application file for complete search history.

(56) References Cited

U.S. PATENT DOCUMENTS

2014/0227017 A1 8/2014 Kanda et al.
2018/0311946 A1 11/2018 Hutchings et al.

FOREIGN PATENT DOCUMENTS

JP S62216771 A 9/1987
JP 2004149135 A * 5/2004
JP 2014043059 A 3/2014
WO 2017151109 A1 9/2017

OTHER PUBLICATIONS

Extended European Search Report dated Jun. 9, 2021, mailed in counterpart European Application No. 20214962.1, 9 pages.

* cited by examiner

*Primary Examiner* — Sharon Polk
(74) *Attorney, Agent, or Firm* — Kim & Stewart LLP

(57) ABSTRACT

According to one embodiment, a label printer for printing labels attached to a mount is provided. The label printer includes detection unit configured to detect a peel-off state of a label to be printed and a printing unit configured to control printing of labels on the mount according to the detected peel-off state of the label to be printed. When the detected peel-off state is total peel-off, the printing unit is configured to advance the mount to a next label on the mount, and when the detected peel-off state is partial peel-off, the printing unit is configured to not print on the label.

20 Claims, 8 Drawing Sheets

LABEL PRINTER AND LABEL PRINTER CONTROL METHOD

CROSS-REFERENCE TO RELATED APPLICATION

This application is based upon and claims the benefit of priority from Japanese Patent Application No. 2020-004633, filed on Jan. 15, 2020, the entire contents of which are incorporated herein by reference.

FIELD

Embodiments described herein relate generally to a label printer and a label printer control program.

BACKGROUND

A label printer issues a label by executing printing on labels attached to a label mount, a backing sheet or the like. Such a label mount, backing sheet, or the like may be in the form a roll or the like. If a sensor detects a label that has been peeled off from a label mount while in a continuous label issuing mode, the printing operation can be stopped to prevent accidental entanglement, loss, or the like of the peeled-off label. After the temporary halt in the printing operation, a user generally must press one or more buttons to perform a position adjustment feeding to adjust a position of the labels or the label mount being fed for printing and then instruct the printer to resume the printing operation.

In such a label printer, however, even in a case where the possibility of accidental label entanglement is low (for example, in a case where a label has been totally peeled off and is not present on a label mount), the printing operation is stopped irrespective of a peel-off state or the degree of peel-off of a label. This causes a frequent interruption of the label printing whenever a label peel-off, whether partial or total, is detected, and a user has to adjust the feeding position, spending extra time and effort every time the label printing comes to an unexpected halt.

Hence, there is a need for a label printer and a label printer control program that can determine suitability of continuation of a printing operation depending on a peel-off state of a label from a mount.

DETAILED DESCRIPTION

In general, according to an embodiment, a label printer for printing labels attached to a mount is provided. The label printer includes a detection unit configured to detect a peel-off state of a label to be printed, and a printing unit configured to control printing of labels on the mount according to the detected peel-off state of the label to be printed. The printing unit is configured to advance the mount to a next label on the mount if the detected peel-off state of a label is total peel-off. When the detected peel-off state is partial peel-off, the printing unit is configured to not print on the label.

Hereinafter, embodiments of a label printer, a label printer control method, and a label printer control program will be described with reference to the accompanying drawings. These example embodiments are non-limiting with respect to the present disclosure.

Figure 1:
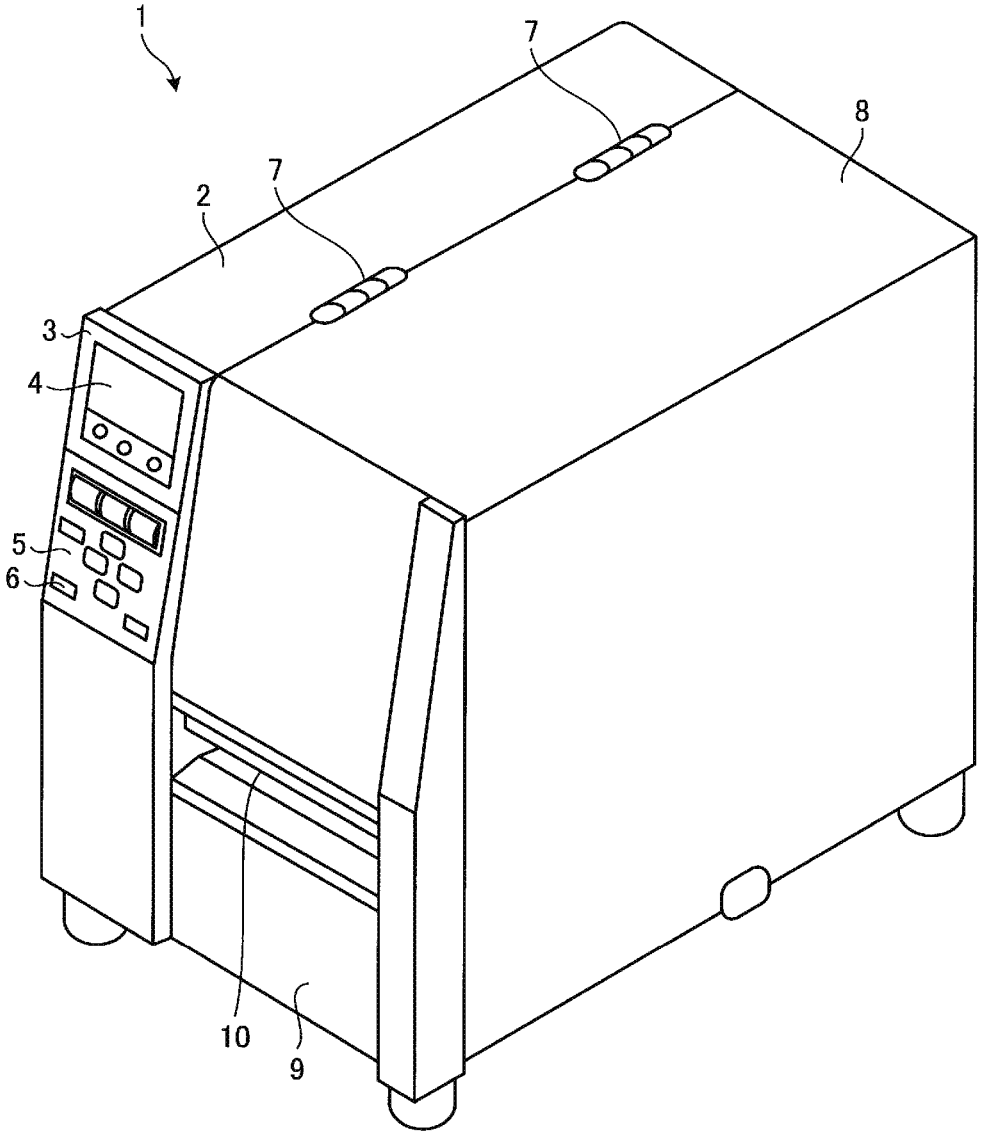
FIG. 1 depicts a label printer in a perspective view according to an embodiment.

FIG. 1 depicts a label printer 1 according to one embodiment. As illustrated in FIG. 1, the label printer 1 includes a left case 2 and a right case 8. The right case 8 is connected to the right side of the left case 2 by hinges 7. A front panel 3 of the left case 2 includes a display unit 4 and an operation unit 5. The display unit 4 comprises, for example, a liquid crystal display with a backlight unit. Other types of a display device may be used. The operation unit 5 includes a plurality of operation buttons 6.

Figure 2:
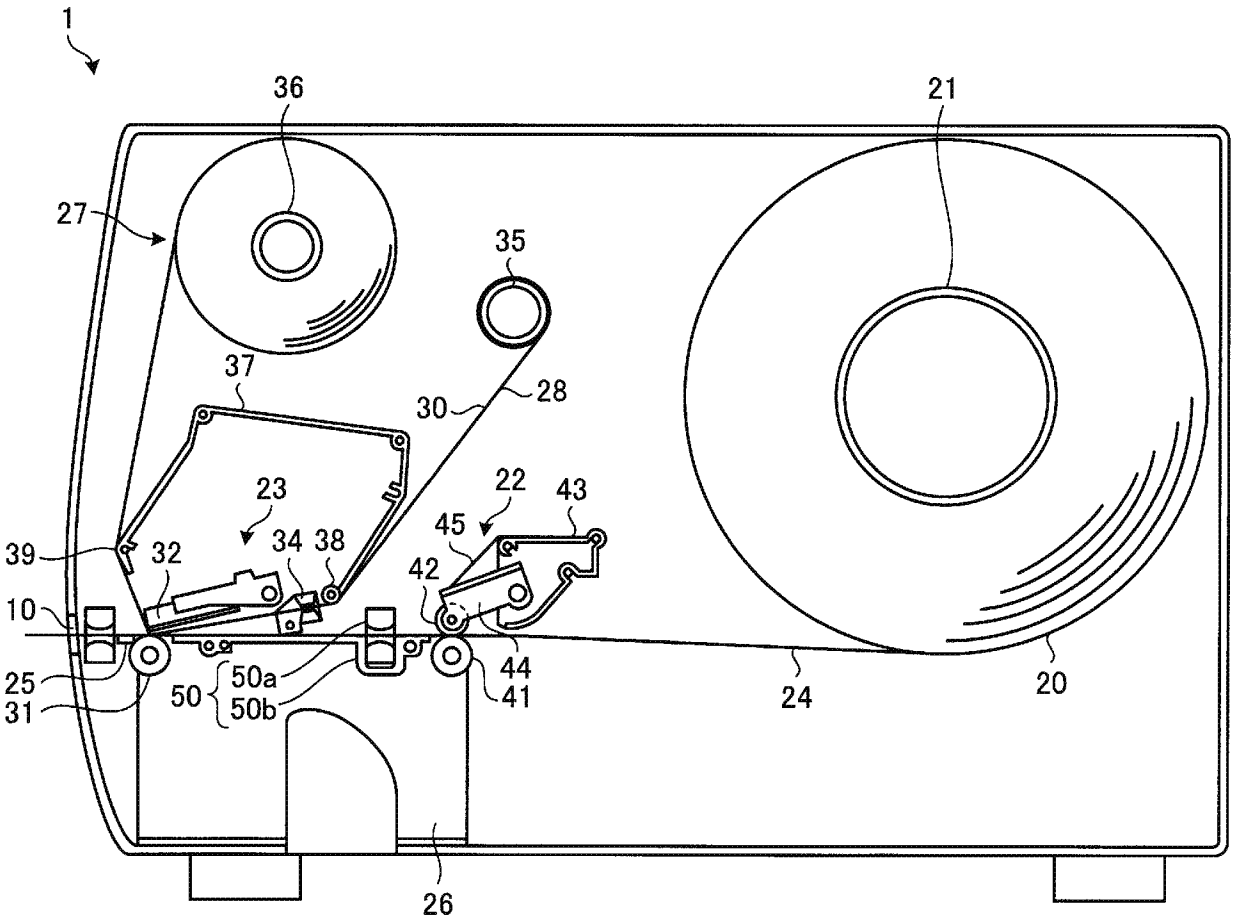
FIG. 2 depicts an internal configuration of a label printer in a cross-sectional view according to an embodiment.

The right case 8 opens by rotation of the hinges 7 to expose the inside of a printer housing that comprises the left and right cases 2 and 8. As shown in FIG. 2, in the printer housing, the label printer 1 includes a label paper 20 that is wound in a roll shape, an ink ribbon 30 that bridges over two shafts, and a printing unit 23 that executes printing on the ink ribbon 30. The label printer 1 according to the present embodiment allows easy access to the internal components by the hinge rotation to widely open the housing such that replacement or maintenance of, for example, the ink ribbon 30 or the label paper 20 can be smoothly done. A label issuing port 10 is provided in a front panel 9 of the right case 8. The label printer 1 issues a printed label from the label issuing port 10.

FIG. 2 is a schematic cross-sectional view illustrating an internal configuration of the label printer 1 according to one embodiment. As illustrated in FIG. 2, besides the label paper 20, the ink ribbon 30, and the printing unit 23, the label printer 1 includes, in the housing, a paper holding unit 21, a paper conveying unit 22, a frame 26, and an ink ribbon supply device 27. The label printer 1 also includes sensors 50 on a conveyance path 24 between the paper conveying unit 22 and the printing unit 23 in the housing.

The paper holding unit 21 is a shaft that winds and holds the label paper 20 in a roll shape. The label paper 20 is drawn from the paper holding unit 21 along the paper conveying unit 22 and is printed by the printing unit 23. The printed label paper 20 is discharged from the label issuing port 10. The label paper 20 has a plurality of labels attached in a row to a label mount, for example.

The paper conveying unit 22 includes a paper conveying roller 41, a pinch roller 42, a frame 43, a support unit 44, and a plate spring 45. The pinch roller 42 is rotatable and supported by the support unit 44. The paper conveying roller 41 and the pinch roller 42 abut against each other via the label paper 20 that is being conveyed therebetween along the conveyance path 24. The paper conveying roller 41 is rotatable and attached to the frame 26 and is driven to rotate by a driving structure, a driver, or the like (not separately depicted).

The support unit 44 is pivotable and attached to the frame 43. One end of the plate spring 45 is attached to the frame 43, and another end of the plate spring 45 abuts against the pinch roller 42. The pinch roller 42 is configured to be biased toward the plate spring 45 and to abut against the paper conveying roller 41.

The conveyance path 24 of the label paper 20 starts from a position where the label paper 20 is drawn from the paper holding unit 21. The conveyance path 24 passes through a position where the pinch roller 42 and the paper conveying roller 41 abut against each other in the paper conveying unit 22. Further, the conveyance path 24 passes through a position where a print head 32 and a platen 31 of the printing unit 23 abut against each other and ends at the label issuing port 10.

In the conveyance path 24, a label peeling plate 25 is also provided downstream of the printing unit 23 in a conveying direction. The label peeling plate 25 bends the label paper 20 while being conveyed along the conveyance path and peels off a label from a label mount. The peeled off mount is wound around a winding shaft (not separately depicted), and the label peeled off from the mount is issued from the label issuing port 10.

The printing unit 23 includes the platen 31 and the print head 32. The print head 32 may be, for example, a line thermal printer. The configuration of the print head 32 corresponds to a print method of the label printer 1. For example, in the case of a dot impact printer, a dot impact print head 32 is used. The platen 31 is rotatable and attached to the frame 26 and is driven to rotate by a driving unit, a driver, or the like (not separately depicted).

The print head 32 is fixed to a head holding unit 33 that is rotatable and attached to a frame (not separately depicted).

The ink ribbon supply device 27 includes a ribbon holding shaft 35, a ribbon winding shaft 36, a ribbon end sensor 34, and a guide frame 37. The ribbon holding shaft 35 winds the unused, new ink ribbon 30 in a roll shape. The ink ribbon supply device 27 also includes a guide roller 38 at an end portion of the guide frame 37 on the ribbon holding shaft 35 side. The guide roller 38 guides the ink ribbon 30 drawn from the ribbon holding shaft 35. The guide roller 38 is rotatably disposed in the guide frame 37.

The ink ribbon 30 before printing abuts against the guide roller 38, passes through a detection target region of the ribbon end sensor 34, reaches a position where the print head 32 and the platen 31 abut against each other, and is transferred onto the label paper 20 by the print head 32. The printed ink ribbon 30 abuts against an end portion 39 of the guide frame 37 on the ribbon winding shaft 36 side and is wound and recovered by the ribbon winding shaft 36.

A conveyance path 28 of the ink ribbon 30 starts from a position where the ink ribbon 30 is drawn from the ribbon holding shaft 35 and passes through a position where the ink ribbon 30 abuts against the guide roller 38 of the guide frame 37. The conveyance path 28 passes through the detection target region of the ribbon end sensor 34 and a position (that is, a print position) where the print head 32 and the platen 31 abut against each other in this order. Further, the conveyance path 28 passes through a position where the ink ribbon 30 abuts against the end portion 39 of the guide frame 37 and ends at a position where the ink ribbon 30 is wound around the ribbon winding shaft 36.

The ribbon end sensor 34 detects a ribbon end, that is, a leading end portion of the ink ribbon 30. As illustrated in FIG. 2, the ribbon end sensor 34 is disposed on the conveyance path 28 between the printing unit 23 and the ribbon holding shaft 35. In one embodiment, the ribbon end sensor 34 may be provided along the conveyance path 28 of the ink ribbon 30 and is provided between the guide roller 38 and the printing unit 23 in the conveyance path 28. In another embodiment, the ribbon end sensor 34 may be provided between the guide roller 38 and a position where the print head 32 and the platen 31 abut against each other (that is, a print position or an ink/image transfer position) in the printing unit 23.

In the case where the guide frame 37 does not have the guide roller 38, the ribbon end sensor 34 may be provided between the end portion of the guide frame 37 on the ribbon holding shaft 35 side and the position where the print head 32 and the platen 31 abut against each other.

As the ribbon end sensor 34, an optical sensor that optically detects the ink ribbon 30 may be used. As another example of the ribbon end sensor 34, a reflected light sensor including a light emitting element and a light receiving element may be used. As still another example of the ribbon end sensor 34, a sensor that mechanically detects the ink ribbon 30 may be used. Examples of the ribbon end sensor 34 are not limited to these.

The sensors 50 are, for example, a plurality of transmission sensors arranged in a width direction of the label mount or the label of the label paper 20. Each of the sensors 50 detects light transmitted through the label paper 20 and outputs a signal of an increase or decrease in transmitted light intensity depending on the conveyance of the label paper 20. In one embodiment, each of the sensors 50 comprises a pair of a light emitting unit 50*a* and a light receiving unit 50*b*. The light emitting unit 50*a* emits light to the label and the mount. The light receiving unit 50*b* receives light that is emitted from the light emitting unit 50*a* and transmits through the label and the mount and outputs an electrical signal that changes depending on the intensity of the received light (that is transmitted light intensity).

In the present embodiment, for convenience of description, the sensors 50 are provided at three positions at regular intervals in the width direction of the mount of the label paper 20. This configuration is merely exemplary, and the number of the sensors 50 is not limited so long as there is at least one sensor 50. In the present embodiment, each sensor 50 is fixedly positioned. In another embodiment, the sensor 50 may be configured to be movable in the width direction. In the present embodiment, each sensor 50 is a transmission sensor as one example. Other examples of the sensor 50 include but not limited to a reflective sensor.

Figure 3:
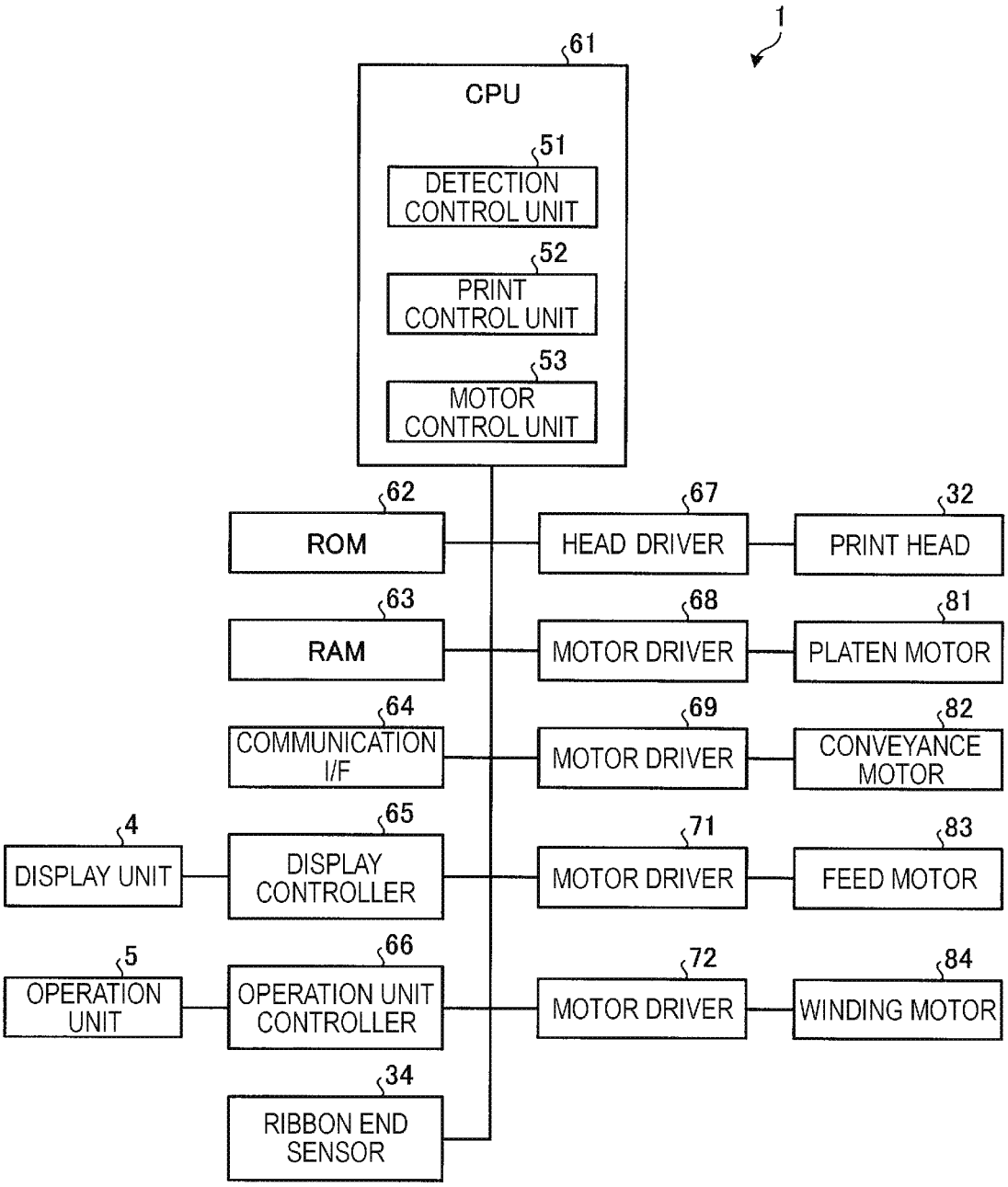
FIG. 3 is a block diagram of a configuration of a label printer according to an embodiment.

FIG. 3 is a block diagram illustrating a part of the configuration of the label printer 1 according to one embodiment. As illustrated in FIG. 3, the label printer 1 includes a CPU 61, a ROM 62, and a RAM 63. The CPU 61 is connected to a communication interface (I/F) 64, a display controller 65, an operation unit controller 66, a head driver 67, motor drivers 68, 69, 71, and 72, and the ribbon end sensor 34 via a bus or an interface.

The display unit 4 is connected to the display controller 65. The operation unit 5 is connected to the operation unit controller 66. The print head 32 is connected to the head driver 67. The print head 32 includes heating elements provided in a line in a direction perpendicular to the conveying direction of the label paper 20. The head driver 67 switches between ON and OFF of energization of the heating elements of the print head 32 based on print data and thermally transfers a print image to the label paper 20.

A platen motor 81 that drives the platen 31 of the printing unit 23 to rotate is connected to the motor driver 68. A conveyance motor 82 that drives the paper conveying roller 41 of the paper conveying unit 22 to rotate is connected to the motor driver 69. A feed motor 83 that drives the ribbon holding shaft 35 to rotate is connected to the motor driver 71. A winding motor 84 that drives the ribbon winding shaft 36 to rotate is connected to the motor driver 72. The configuration of each of the motors is not limited so long as each motor performs the necessary function for the label printer 1 to perform the label printing. Examples of the motor include but not limited to a stepping motor.

The ROM 62 stores a program or programs (hereinafter collectively referred to as a program) to be executed by the CPU 61 or the like of the label printer 1 and various data upon the execution of the program. The RAM 63 is a memory for loading that temporarily stores the program and the data upon the program execution. The communication I/F 64 connects the label printer 1 with a host computer (not separately depicted) and controls data communication between the label printer 1 and the host computer. The host computer transmits print data, a print command, or the like to the RAM 63 via the communication I/F 64. In another instance, the print data may be input via the operation unit 5.

In one instance, the program is provided by being incorporated into the ROM 62 or the like in advance. In another instance, the program may be provided by being recorded in a non-transitory computer-readable recording medium such as a CD-ROM, a flexible disk (FD), a CD-R, or a Digital Versatile Disk (DVD) in a file format that is installable to and executable by a computer or the label printer 1.

In still another instance, the program may be stored in a computer connected to a network such as the Internet in advance and may be downloaded from the computer via the network for use by the label printer 1. The program may be provided or distributed by a network such as the Internet.

As illustrated in FIG. 3, the program to be executed by the CPU 61 of the label printer 1 according to the present embodiment has a module configuration including a print control unit 52, a detection control unit 51, and a motor control unit 53. The CPU 61 (or a processor) reads the program from a storage medium such as the ROM 62 and loads the respective units of the program to a main memory such as the RAM 63. As a result, the detection control unit 51, the print control unit 52, the motor control unit 53 are generated on the main memory.

The detection control unit 51 is an example of a detection unit configured to detect a peel-off state of a label from a label mount before the print control unit 52 performs a printing process. The detection control unit 51 detects whether the label on the label mount of the print paper 20 that is about to be conveyed to the printing unit 23 (FIG. 2) is in a "no peel-off" state, or in a "partial peel-off" state, or in a "total peel-off" state, based on the electrical signals output from the sensors 50.

Figure 4:
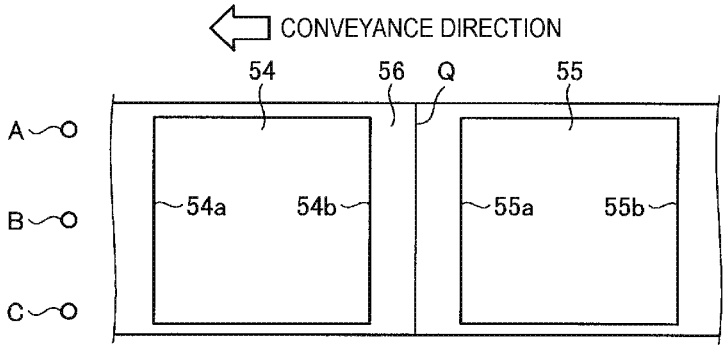
FIG. 4 depicts an example case of a "no peel-off" state according to an embodiment.

FIG. 4 depicts an example case where the peel-off state of a label 55 from a mount 56 indicates "no peel-off" according to one embodiment. An arrow indicates the conveying direction of the mount 56 along the conveyance path 24 in the label printer 1, and A, B, and C indicate three positions of the sensors 50 provided in the width direction of the mount 56, respectively. The same shall be applied to FIGS. 6, 8, and 10.

Figure 5A:
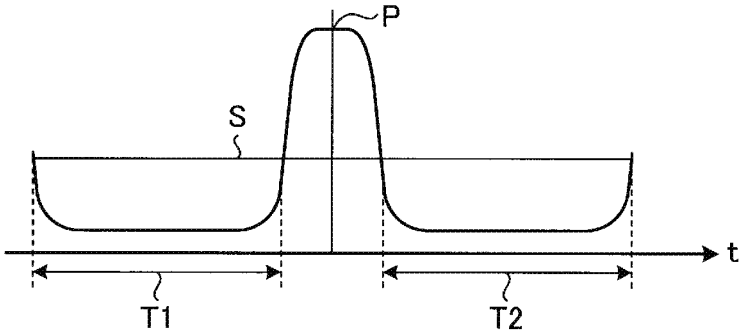
FIGS. 5A, 5B, and 5C depict example outputs of sensors at three positions along a width direction of the mount according to an embodiment.
Figure 5B:
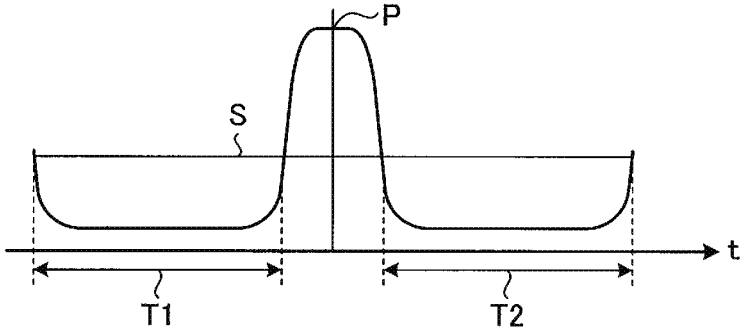
Figure 5C:
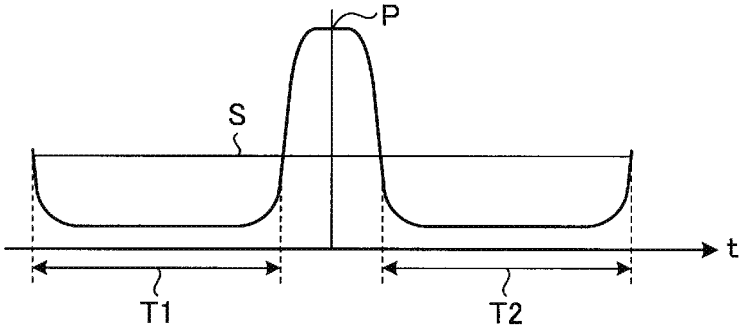

FIGS. 5A, 5B, and 5C depict example output signals from the sensors 50 provided at the three positions A, B, and C in FIG. 4. In each of the graphs, an increase or decrease in the output signal of each sensor 50 corresponds to an increase or decrease in transmitted light intensity. The same applies for the depictions in FIGS. 7A-7C, 9A-9C, and 11A-11C.

In the example of FIG. 4, the label 55 does not have any portion thereof peeled off from the mount 56. In this case, as illustrated in FIGS. 5A-5C, the output signal of each of the sensors 50 increases at a trailing edge portion 54*b* of a label 54, that is a previous label located immediately before the label 55 on the mount 56, and decreases at a leading edge portion 55*a* of the label 55. The output signal shows a maximum value at a center portion Q of a gap portion between the label 54 and the label 55 where only the mount 56 is present. The portion of the output signal curve including the maximum value will be referred to as a peak P of the output signal. A portion indicated by symbol S in FIG. 5 is a threshold S. The threshold S is a value used by the detection control unit 51 to recognize an edge such as the leading edge portion 55*a* or a trailing edge portion 55*b* of the label 55 and may be set to an arbitrary value.

In consideration of the fact that the transmitted light intensity rapidly increases at a position where the label 55 changes to the mount 56 on the label paper 20 and rapidly decreases at a position where the mount 56 changes to the label 55 on the label paper 20, the detection control unit 51 detects the leading edge portion 55*a* and the trailing edge portion 55*b* of the label 55 at each of the positions A, B, and C based on the output of each of the sensors 50 and determines the peel-off state based on the detection result.

The detection control unit 51 determines a position where the output of each of the sensors 50 increases passing the threshold S as the trailing edge portion 54*b* of the label 54 at each of the positions A, B, and C. The detection control unit 51 determines a position where the output of each of the sensors 50 decreases passing the threshold S as the leading edge portion 55*a* of the label 55. The trailing edge portion 54*b* of the label 54 and the leading edge portion 55*a* of the label 55 are, respectively, the start and end of the gap portion between the label 54 and the label 55 on the mount 56 exists.

The detection control unit 51 detects the peel-off state of the label 55 based on the length of a period where the output of each of the sensors 50 falls below the threshold S after the peak P. For example, based on the output curve of each sensor 50 as shown in FIG. 5, the detection control unit 51 determines that there is no peeled-off portion present in the label 55 and that the peel-off state of the label 55 is "no peel-off" because the length of the period where the output signal of each of the sensors 50 falls below the threshold S is equal to a predetermined period T2. The period T2 may be set in advance corresponding to a length of one label in the conveyance direction.

Figure 6:
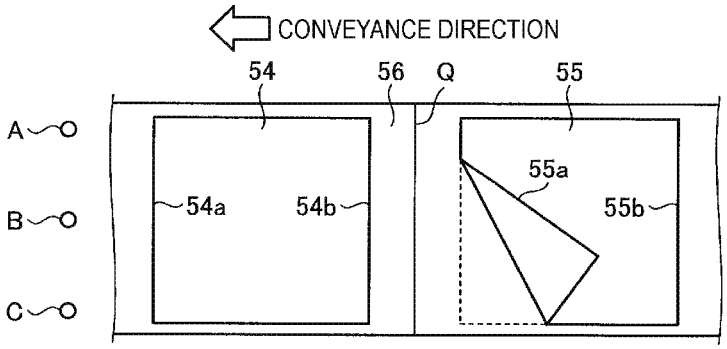
FIG. 6 depicts an example case of a "partial peel-off" state according to an embodiment.
Figure 7A:
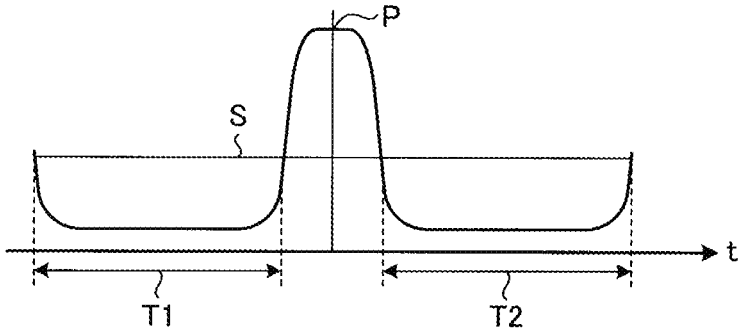
FIGS. 7A, 7B, and 7C depict example outputs of sensors at three positions along a width direction of a label mount.

FIG. 6 depicts an example case where the peel-off state of the label 55 from the mount 56 is "partial peel-off" according to one embodiment. A broken line virtually indicates a part of the label 55 that has been peeled off. FIGS. 7A-&C depicts example output signals of the sensors 50 at the three positions A, B, and C in FIG. 6.

Figure 7B:
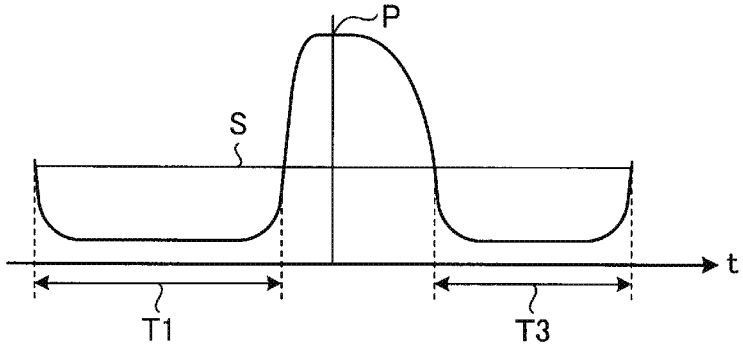
Figure 7C:
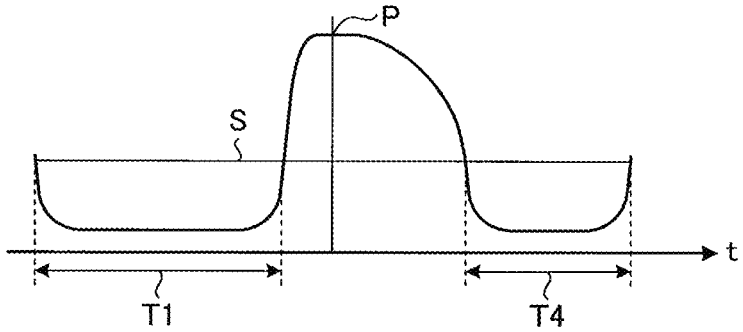

As illustrated in FIG. 6, the label 55 is in a state where a part of the leading edge portion 55*a* has been peeled off. The peeled-off part exists at a position corresponding to the sensor positions B and C. In this case, as illustrated in FIG. 7A-7C, the output signal decreases below the threshold S in order of the sensor 50 at the position A, the sensor 50 at the position B, and the sensor 50 at the position C according to a change in the position of the leading edge portion 55*a* of the label 55 caused by the partial peel-off.

The detection control unit 51 then determines that there is a partially peeled-off portion present in the label 55 and that the peel-off state of the label 55 is "partial peel-off" because there is a period in the output curve that falls below the threshold S after the peak S for less than the predetermined period T2 such as T3 and T4. The detection control unit 51 may further determine that the partially peeled-off portion exists in a part of the leading edge portion 55*a* of the label 55 on the sensor position C side because the lengths of the periods where the outputs L of the sensors 50 at the respective positions A, B, and C fall below the threshold S after the peak P satisfy a predetermined time-duration relation of T2>T3>T4, where T4 of the output curve of the sensor 50 at the position C is the shortest period.

Figure 8:
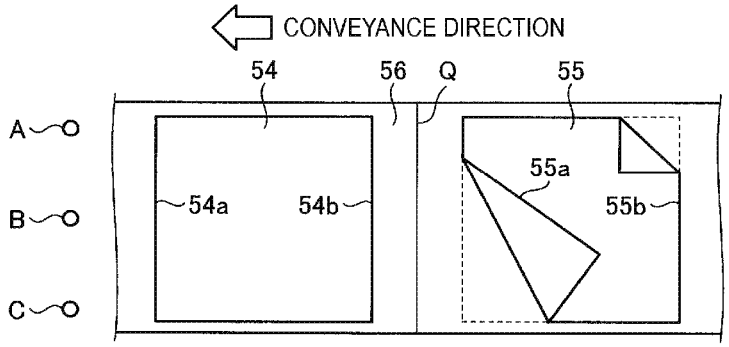
FIG. 8 depicts an example case of a "partial peel-off" state according to an embodiment.

FIG. 8 depicts another example case where the peel-off state of the label 55 from the mount 56 is "partial peel-off" according to one embodiment. A broken line in FIG. 8 virtually indicates a part of the label 55 that has been peeled off. FIG. 9 depicts graphs of the example outputs L of the sensors 50 that are provided at positions A, B, and C in FIG. 8.

As illustrated in FIG. 8, the label 55 is in a state where there are two parts thereof peeled off from the mount 56: a first peeled-off part is of the leading edge portion 55*a* at a position corresponding to the sensor positions B and C; and a second peeled-off part is of the trailing edge portion 55*b* at a position corresponding to the sensor position A.

Figure 9A:
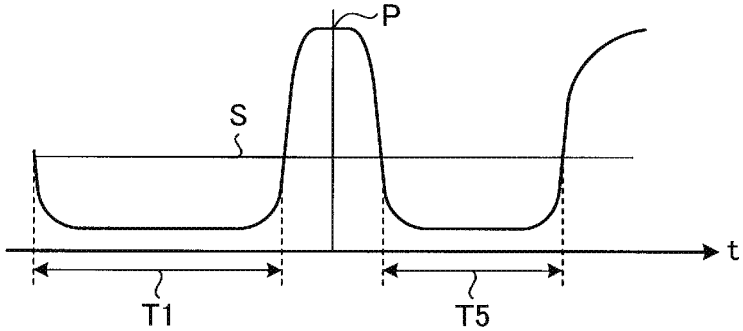
FIGS. 9A, 9B, and 9C depict of example outputs of sensors at three positions along a width direction of a label mount.
Figure 9B:
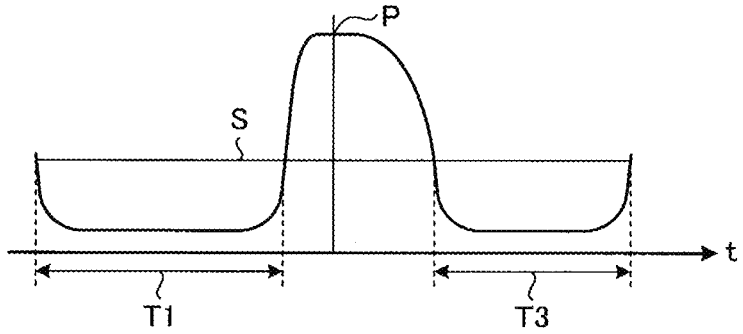
Figure 9C:
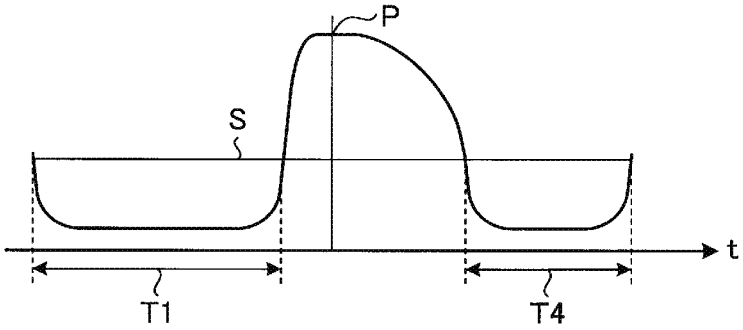

In this case, as illustrated in FIGS. 9A-C, the output decreases below the threshold S in order of the sensor 50 at the position A, the sensor 50 at the position B, and the sensor 50 at the position C according to a change in the position of the leading edge portion 55*a* of the label 55 caused by a partial peel-off. Subsequently, the output increases above the threshold S in order of the sensor 50 at the position A and the sensors 50 at the respective positions B and C according to a change in the position of the trailing edge portion 55*b* of the label 55 caused by the second partial peel-off.

The detection control unit 51 then determines that there is at least one partially peeled-off portion present in the label 55 and that the peel-off state of the label 55 is "partial peel-off" because there is a period in the output curve that falls below the threshold S after the peak S for less than the predetermined period T2 such as T3 and T4. The detection control unit 51 may further determine that two partially peeled-off portions exist in a part of the leading edge portion 55*a* of the label 55 on the sensor position C side and also in a part of the trailing edge portion 55*b* of the label 55 on the sensor position A side because the detection control unit 51 identifies the following conditions in the respective output curves: the timings at which the outputs of the sensors 50 at the respective positions A, B, and C fall below the threshold S are in order of A, B, and C; the timing at which the output of the sensor 50 at the position A exceeds the threshold S after passing the peak P is faster than those of the output curves of the sensors at the position B and C; the timings at which the outputs L of the sensors 50 at the respective positions B and C exceed the threshold S after passing the peak P are substantially the same with one another; and the lengths of the periods where the outputs L of the sensors 50 at the respective positions A, B, and C fall below the threshold S satisfy a predetermined time-duration relation of T2>T5, T3, and T4.

Figure 10:
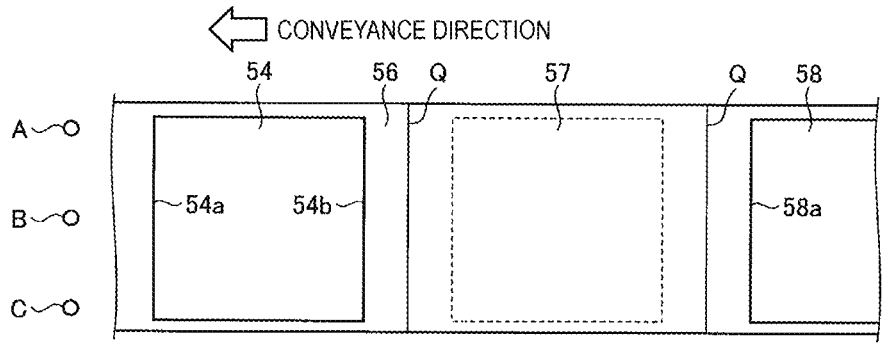
FIG. 10 depicts an example case of a "total peel-off" state according to an embodiment.
Figure 11A:
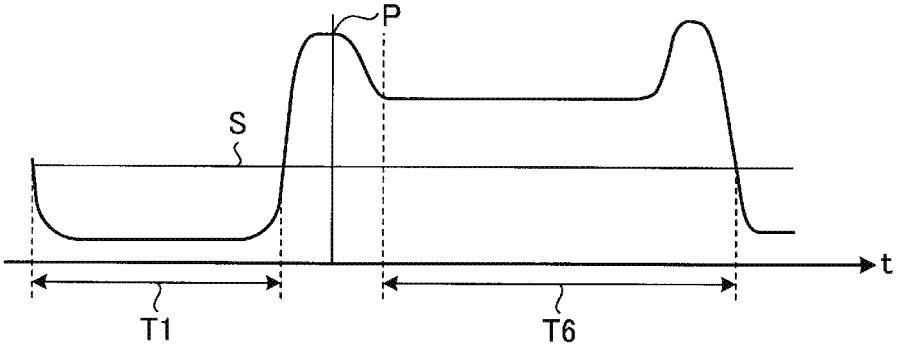
FIGS. 11A, 11B, and 11C depict example outputs of sensors at three positions along a width direction of a label.
Figure 11B:
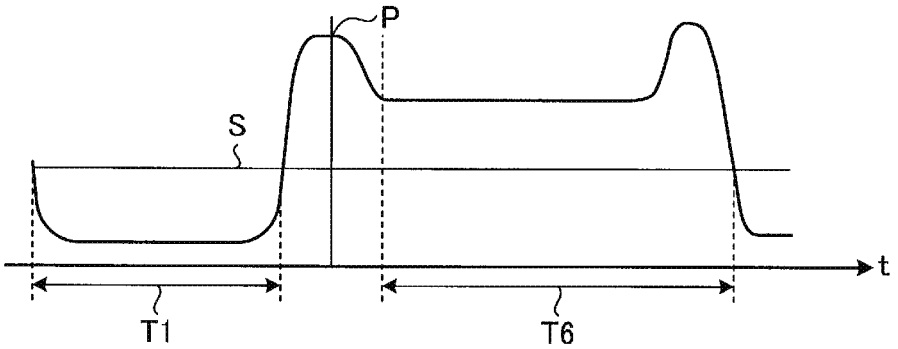
Figure 11C:
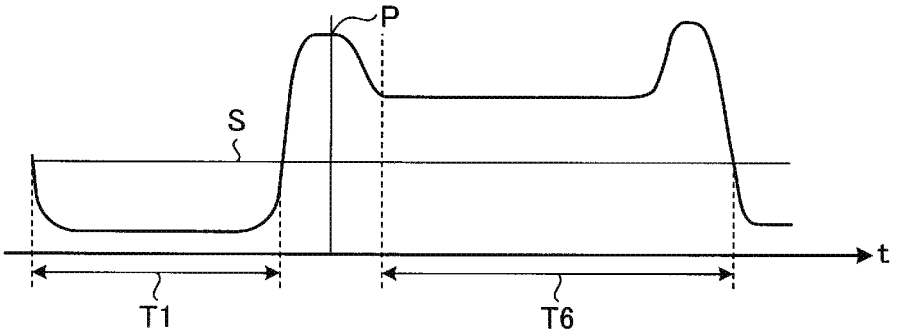

FIG. 10 is a diagram of an example case where the peel-off state of the label 55 from the mount 56 indicates "total peel-off" according to one embodiment. A broken line region 57 in FIG. 10 indicates the previous position of the label 55 that has been peeled off from the mount 56. FIG. 11A-11C depicts example outputs of the sensors 50 that are provided at the three positions A, B, and C in FIG. 10.

As illustrated in FIG. 10, the label 55 has been totally peeled off from the mount 56. In this case, as illustrated in FIG. 11A-11C, since the label 55 is not present on the mount 56, the output of each of the sensors 50 at the three positions A, B, and C stays at a constant value that exceeds the threshold S after the peak P for a period T6. The period T6 is, for example, a predetermined period from detection of a trailing edge portion 54*b* of a previous label 54, that is a label located immediately before the totally peeled-off label 55 on the mount 56, to detection of a leading edge portion 58*a* of a next label 58, that is the label located immediately after the missing (totally peeled-off) label 55 on the mount 56.

The detection control unit 51 then determines that the label 55 is totally peeled off and that the peel-off state of the label 55 is "total peel-off" because the output of each of the sensors 50 at the three positions A, B, and C stays at the constant value exceeding the threshold S after the peak P for the period T6 or more.

In one embodiment, if the leading edge portion 55*a* and the trailing edge portion 55*b* of the label 55 are not detected at any of the sensor positions A, B, and C for a section of the label paper 20 corresponding to an N number of labels, the detection control unit 51 may also determine a state where an N number of labels in a row are not present on the label mount.

Referring back to FIG. 3, the print control unit 52 is an example of a printing unit configured to control an operation of the print head 32 via the head driver 67 and to transfer the print data to the label paper 20 when the print data is input via the communication I/F 64 or the operation unit controller 66.

The print control unit 52 executes the printing process in at least one of a "label issue peel-off mode" and a "label issue continuous mode" according to one embodiment. The "label issue peel-off mode" is an operation mode where printed labels are individually issued from a label issuing port (such as the label issuing port 10 in FIG. 2) after being peeled off from a label mount by a peeling unit. The "label issue continuous mode" is an operation mode where labels are to be continuously printed for a target number of labels, which, for example, has been set by a user, and are issued together with the label mount (that is, in an unpeeled state), without a separate peeling operation of each label after printing like in the label issue peel-off mode.

The print control unit 52 may further control the printing process in an "automatic feed mode" according to one embodiment. When the "automatic feed mode" is selected, the print control unit 52 determines suitability for the continuance of the printing operation depending on the peel-off state detected by the detection control unit 51 and then controls the label printing operation based on the determination result. For example, in the "automatic feed mode" operation, if the peel-off state detected by the detection control unit 51 is a total peel-off state where a label is entirely missing from an expected position on the mount (label paper 20), the label paper 20 is automatically fed to another printing position for the next printable label while skipping the printing attempt on a label-missing region, and this process is continued until a total target number of labels are printed and issued. During the automatic feed mode, the function of the label issue continuous mode, which allows the printing unit to continuously execute printing for the target number of labels, is maintained.

If the detection control unit 51 detects peel-off of at least a part of the label from the mount, the print control unit 52 controls printing according to the peel-off state detected by the detection control unit 51. In the automatic feed mode, when the detection control unit 51 determines that the peel-off state is "no peel-off", the print control unit 52 executes printing on the labels, and, when the detection control unit 51 determines that the peel-off state is "partial peel-off", the print control unit 52 stops printing on the labels and outputs an error message. However, in the "automatic feed mode," when the detection control unit 51 determines the "total peel-off" state, the print control unit 52 automatically conveys or feeds the label mount corresponding to the position of the totally peeled off label without attempting printing thereon and then returns to continuously executing printing on the labels after the position of the totally peeled off label.

The print control unit 52 can shift to the automatic feed mode by a specific operation executed during the label issue continuous mode.

The motor control unit 53 is an example of a printing unit and controls the rotation of the platen motor 81 via the motor driver 68. The motor control unit 53 also controls the rotation of the conveyance motor 82 via the motor driver 69. Further, the motor control unit 53 controls the rotation of the feed motor 83 via the motor driver 71. Still further, the motor control unit 53 controls the rotation of the winding motor 84 via the motor driver 72.

When the "automatic feed mode" is selected, the motor control unit 53 controls the conveying operation of the mount according to the peel-off state determined by the detection control unit 51. For example, in the "automatic feed mode," when the detection control unit 51 determines the "total peel-off" state, the motor control unit 53 automatically conveys the mount past the position corresponding to the totally peeled-off label in order to execute label printing without unnecessary delay. In the example illustrated in FIG. 10, when the detection control unit 51 determines the "total peel-off" state of the label 55, the motor control unit 53 automatically conveys the mount past the position corresponding to the label 55 in order to speedily execute printing on the label 54 (positioned before the peeled off label 55) and the next label 58 (positioned after the peeled off label 55).

Figure 12:
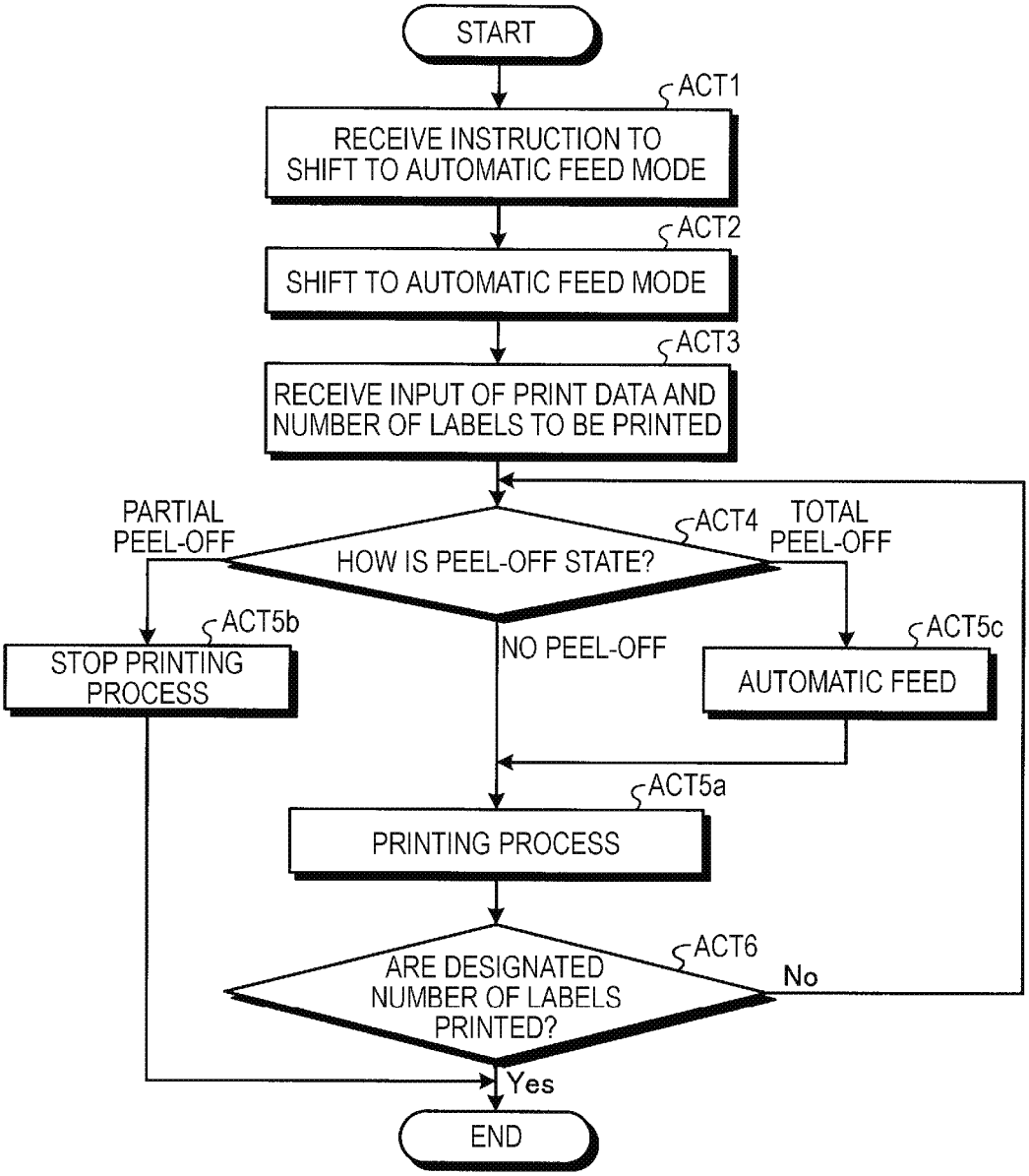
FIG. 12 is a flowchart of an operation of a label printer according to an embodiment.

FIG. 12 is a flowchart of a printing operation of the label printer 1 according to one embodiment.

First, the print control unit 52 receives an instruction to shift to the automatic feed mode (ACT 1). The instruction is input via the communication I/F 64 or the operation unit 5. The instruction to shift to the automatic feed mode may be executed, for example, by a specific operation (for example, long-pressing, simultaneous pressing of multiple buttons, or rapidly repeated pressing) on a button or buttons of the operation unit 5 or the like when peel-off of a label in an estimated printing range is verified by visual inspection of a user before executing continuous label printing in the label issue continuous mode.

The print control unit 52 shifts to the automatic feed mode in response to the instruction to shift to the automatic feed mode (ACT 2). The print control unit 52 receives an input of print data and the target number of labels to be printed from the communication I/F 64 or the operation unit 5 (ACT 3).

The detection control unit 51 detects a peel-off state of the label that is about to be conveyed to a printing position (ACT 4). When the detection control unit 51 determines that the peel-off state is "no peel-off" for the label about to be printed (ACT 4: no peel-off), the print control unit 52 then proceeds to execute the printing process on the label (ACT 5*a*). When the detection control unit 51 determines that the peel-off state for the label about to be printed is "partial peel-off" (ACT 4: partial peel-off), the print control unit 52 stops the printing process on the label (ACT 5*b*) and outputs an error message.

When the detection control unit 51 determines that the peel-off state for the label about to be printed is "total peel-off" (ACT 4: total peel-off), the motor control unit 53 is configured to execute an automatic feed, that is, the motor control unit 53 automatically advances or feeds the mount past the mount position corresponding to the totally peeled-off label without printing thereto. The next label on the mount (assuming the peel-off state for such a label is detected as "no peel-off") can then be printed without substantial delay (ACT 5*c*).

The print control unit 52 can execute printing on the next label after the peeled off label (ACT 5*a*).

The print control unit 52 determines whether the number of printed labels reaches the number of labels to be printed that has been input or designated in ACT 3 (ACT 6). When the print control unit 52 determines that the number of printed labels has reached the designated number of labels to be printed, the print control unit 52 ends the printing process in the "label issue continuous mode" (Yes in ACT 6). If the print control unit 52 determines that the number of printed labels has not reached the designated number of labels to be printed (No in ACT 6), the print control unit 52 repeatedly executes the processes from ACT 4 to ACT 6.

According to one or more embodiments, the label printer 1 executes printing on each of a plurality of labels attached to a continuous mount, such as a label roll or the like. The label printer 1 includes the detection control unit 51 as a detection unit or a detector and the print control unit 52 as a printing unit. The detection control unit 51 is configured to detect a peel-off state of a label 55 from the mount 56 before attempting a printing on the label 55. The print control unit 52 is configured to control printing according to the peel-off state detected by the detection control unit 51 such as if the detection control unit 51 detects a peel-off or a partial peel-off of the label 55, printing can be stopped or skipped. For example, when the detection control unit 51 does not detect a peel-off of the label 55 from the mount 56, the print control unit 52 executes printing on the label 55 normally, but when the detection control unit 51 detects a partial peel-off of the label 55 from the mount 56, the print control unit 52 stops/skips the printing on the label 55. Furthermore, when the detection control unit 51 detects a total peel-off of the label 55 from the mount 56, the printing unit automatically advances the mount 56 past the position corresponding to the totally peeled off label 55 so near continuous printing on the labels before and after the missing, peeled off label can be performed.

Accordingly, in the label printer 1 according to at least one of the embodiments, the print control unit 52 can determine suitability for continuance of the printing operation depending on the peel-off state detected by the detection control unit 51 and can control the printing operation on the labels based on the determination result. That is, when a label is totally missing from a position on the mount, such as with a total peel-off, the mount can be automatically fed so that the next printable label moves to the printing position while printing on a label-missing region is skipped, and the printing process can be continued without interruption until a target number of labels are issued. This way, when the total label peel-off is detected, stopping the printing operation, and then requiring the user to manually press a button to execute the position adjustment feeding process before resuming the printing operation are not necessary. Consequently, the number of times the printing operation is interrupted can be reduced, and the throughput in the label issuing process can be improved. In addition, the frequency of the position adjustment feeding caused by the operation of stopping printing can be reduced, and the operating load on the user can be reduced.

MODIFICATION EXAMPLE 1

In one embodiment, the automatic feed mode is shifted to from the label issue continuous mode. In a modified example, the automatic feed mode may be shifted to from the label issue peel-off mode.

MODIFICATION EXAMPLE 2

In one embodiment, when it is determined that the peel-off state is a partial peel-off, the printing process is stopped, and an error message is output for preventing the entanglement of a label within the printer. In a modified example, the mount corresponding to the label that has been determined to be in the partial peel-off state may still be automatically conveyed even though the printing process for the particular partially peeled label is skipped. Thus, printing on the labels before and after the partially peeled label can be performed without substantial delay.

MODIFICATION EXAMPLE 3

In one embodiment, the peel-off state is determined based on the length of the period for which the output falls below the threshold S after the peak P or the length of the period where the output exceeds the threshold S after the peak P. In a modified example, the peel-off state may be determined by comparing the timing at which the output of each of the sensors 50 increases above the threshold S (that is, the timing at which the trailing edge portion 55*b* of the label 55 is detected) and the timing at which the output of each of the sensors 50 decreases below the threshold S (that is, the timing at which the leading edge portion 55*a* of the label 55 is detected).

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A label printer for printing labels attached to a mount, comprising:

a detection unit configured to detect a peel-off state of a label to be printed; and a printing unit configured to control printing of labels on the mount according to the detected peel-off state of the label to be printed, wherein if the detected peel-off state is total peel-off, the printing unit is configured to advance the mount to a next label on the mount, and if the detected peel-off state is partial peel-off, the printing unit is configured to not print on the label.

2. The label printer according to claim 1, wherein if the detected peel-off state is partial peel-off, the printing unit is configured to issue an error notification.

3. The label printer according to claim 1, wherein if the detected peel-off state is partial peel-off, the printing unit is configured to halt the printing of labels.

4. The label printer according to claim 1, wherein if the detected peel-off state is partial peel-off, the printing unit is configured to advance the mount to the next label on the mount.

5. The label printer according to claim 4, wherein the printing unit is configured to automatically print on the next label after the mount advances to the next label.

6. The label printer according to claim 1, wherein if the detected peel-off state is total peel-off, the printing unit is configured to automatically print on the next label after the mount advances to the next label.

7. The label printer according to claim 1, wherein the label printer operates in one of a label peel-off issue mode in which label printing and label peel-off from the label mount are alternately repeated and a label continuous issue mode in which printing is continuously executed on each of a plurality of labels.

8. The label printer according to claim 7, wherein in the label peel-off issue mode, each printed label is peeled off the label mount one by one at time of issue, and in the label continuous issue mode, printed labels are continuously issued without peeling off from the label mount until a target number of printed labels is reached.

9. The label printer according to claim 8, wherein, if in the label continuous issue mode when the detection unit detects a total peel-off of the label to be printed, the printing unit advances the label mount and executes printing on a label located on the label mount after the totally peeled-off label to be printed.

10. The label printer according to claim 1, further comprising:

a sensor each configured to detect light transmitted through the label mount while the label mount is conveyed along a conveyance path, wherein the detection unit is further configured to determine the peel-off state based on output of the sensor.

11. A label printer configured to print labels disposed in series on a continuous label mount, the label printer comprising:

a detector configured to detect a peel-off state of a label to be printed;

a print head for printing of labels on the mount;

a printing control unit configured to control the printing of labels on the mount according to the detected peel-off state of the label to be printed, wherein if the detected peel-off state is total peel-off, the printing unit is configured to advance the mount to a next label on the mount, and if the detected peel-off state is partial peel-off, the printing unit is configured to not print on the label.

12. The label printer according to claim 11, wherein if the detected peel-off state is partial peel-off, the printing unit is configured to issue an error notification.

13. The label printer according to claim 11, wherein if the detected peel-off state is partial peel-off, the printing unit is configured to halt the printing of labels.

14. The label printer according to claim 11, wherein if the detected peel-off state is partial peel-off, the printing unit is configured to advance the mount to the next label on the mount.

15. The label printer according to claim 14, wherein the printing unit is configured to automatically print on the next label after the mount advances to the next label.

16. The label printer according to claim 11, wherein if the detected peel-off state is total peel-off, the printing unit is configured to automatically print on the next label after the mount advances to the next label.

17. The label printer according to claim 11, wherein the detector includes a sensor configured to detect an intensity of light transmitted through the label mount.

18. A non-transitory computer-readable medium storing therein a program, which when executed, causes a label printer to perform a method comprising:

conveying a label mount having a plurality of labels thereon along a conveyance path adjacent in part to a print head;

detecting a peel-off state of a label to be printed;

advancing the label mount to a next label on the label mount when the detected peel-off state is total peel-off; and not printing on the label when the detected peel-off state is partial peel-off.

19. The non-transitory computer-readable medium according to claim 18, the method further comprising:

issuing an error notification and halting printing of labels when the detected peel-off state is partial peel-off.

20. The non-transitory computer-readable medium according to claim 18, the method further comprising:

advancing the mount to the next label on the label mount if the detected peel-off state is partial peel-off.

* * * * *